US009016521B2

(12) United States Patent
Foster

(10) Patent No.: US 9,016,521 B2
(45) Date of Patent: Apr. 28, 2015

(54) PRODUCT DISPENSER PACKAGE FOR PERSONAL USE

(71) Applicant: Diana Foster, Potomac, MD (US)

(72) Inventor: Diana Foster, Potomac, MD (US)

( * ) Notice: Subject to any disclaimer, the term of this patent is extended or adjusted under 35 U.S.C. 154(b) by 3 days.

(21) Appl. No.: 13/766,422

(22) Filed: Feb. 13, 2013

(65) Prior Publication Data

US 2013/0228591 A1 Sep. 5, 2013

Related U.S. Application Data

(63) Continuation-in-part of application No. 13/560,378, filed on Jul. 27, 2012.

(60) Provisional application No. 61/512,024, filed on Jul. 27, 2011.

(51) Int. Cl.

| | |
|---|---|
| ***B65D 35/00*** | (2006.01) |
| ***B65D 35/40*** | (2006.01) |
| ***B65D 35/28*** | (2006.01) |
| ***B65D 35/44*** | (2006.01) |

(52) U.S. Cl.

CPC ..... *B65D 35/40* (2013.01); *B65D 35/28* (2013.01); *B65D 35/44* (2013.01)

(58) Field of Classification Search

CPC ..... B65D 35/00; B65D 35/04; B65D 35/44

USPC ..... 222/92, 107, 157–159, 527–530, 222/213–215

See application file for complete search history.

(56) References Cited

U.S. PATENT DOCUMENTS

| | | | | |
|---|---|---|---|---|
| 2,390,822 | A * | 12/1945 | Wren | 222/572 |
| 3,224,640 | A * | 12/1965 | Schneider et al. | 222/107 |
| 3,315,849 | A * | 4/1967 | Herzig | 222/491 |
| 3,462,070 | A * | 8/1969 | Corella | 206/219 |
| 3,635,376 | A * | 1/1972 | Hellstrom | 222/107 |
| 3,815,794 | A * | 6/1974 | Carlisle | 222/491 |
| 4,163,509 | A * | 8/1979 | Amneus | 222/95 |
| 4,312,689 | A * | 1/1982 | Amneus | 156/160 |
| 4,640,425 | A * | 2/1987 | Cabernoch | 215/11.6 |
| 4,711,359 | A * | 12/1987 | White et al. | 215/11.1 |
| 4,805,767 | A * | 2/1989 | Newman | 206/219 |
| 5,373,966 | A * | 12/1994 | O'Reilly et al. | 222/94 |
| 5,407,107 | A * | 4/1995 | Smith | 222/548 |
| 6,244,468 | B1 * | 6/2001 | Farmer et al. | 222/107 |
| 6,685,058 | B2 * | 2/2004 | Redmond | 222/107 |
| 6,783,030 | B2 * | 8/2004 | Redmond | 222/107 |
| 7,143,910 | B2 * | 12/2006 | Redmond | 222/107 |
| 7,765,987 | B2 * | 8/2010 | Steinbauer et al. | 123/490 |
| 8,500,707 | B2 * | 8/2013 | Murray | 604/332 |
| 8,931,664 | B2 * | 1/2015 | Foster | 222/107 |

* cited by examiner

*Primary Examiner* — Frederick C Nicolas

(74) *Attorney, Agent, or Firm* — Robert M. Downey, P.A.

(57) ABSTRACT

A product dispenser package for storing a viscous product for personal use comprises a container including an interior chamber extending to a sealable opening, the interior chamber being structured and disposed for holding the viscous product, and whereby squeezing one's fingers against the container and directing one's fingers along the length of the container from the bottom end of the container towards the top end of the container forces the viscous product out of the interior chamber through the opening. In a preferred embodiment, a portion of the relevant end of the dispenser package is folded over on itself to prevent inadvertent emission of the product. The folded segments may be sealed with a food grade adhesive or held together by a band sized for engaged receipt of the folded segments.

8 Claims, 7 Drawing Sheets

PRODUCT DISPENSER PACKAGE FOR PERSONAL USE

This application is a continuation-in-part application of co-pending patent application Ser. No. 13/560,378, filed on Jul. 27, 2012, which is based on U.S. Provisional Patent Application Ser. No. 61/512,024 filed on Jul. 27, 2011.

BACKGROUND OF THE INVENTION

1. Field of the Invention

The present invention relates to product dispensers and, more particularly, a product dispenser package for dispensing products such as toothpaste, shampoo, liquid cosmetics, medicinal liquids and creams, and food items for personal use.

2. Discussion of the Related Art

Several products, such as toothpaste, mouthwash, shampoo and liquid cosmetics, are stored in dispenser packages sized for personal use in order to provide a level of flexibility and convenience for users. Such product dispenser packages are particularly useful when traveling, as it is often desirable to pack as lightweight as possible due to weight restrictions on baggage and/or limited storage space. Dispenser packages sized for personal use are also desirable for retail establishments marketing a particular product giving away or selling single-use samples of the product.

In addition, it can be desirable for children to use dispenser packages for personal use in order to limit mess on countertops and to prevent product residue from building around the dispenser package's opening, which often occurs during use of traditional product dispensers.

Therefore, there remains a need for a product dispenser package for personal use that provides easy and sanitary delivery of a product and which is adaptable for dispensing both liquid and viscous products.

OBJECTS AND ADVANTAGES OF THE INVENTION

Considering the foregoing, it is a primary object of the present invention to provide a product dispenser package for personal use that is adaptable for dispensing both liquid and viscous products.

It is a further object of the present invention to provide a product dispenser package for personal use that allows for sanitary dispensing of a product, wherein delivery of the product does not require the package to physically contact the receptacle receiving the product.

It is a further object of the present invention to provide a product dispenser package for personal use that is easy to use.

It is a further object of the present invention to provide a product dispenser package for personal use that can be easily opened prior to dispensing the product and will not result in inadvertent emission of the liquid or viscous product contained therein.

It is still a further object of the present invention to provide a product dispenser package for personal use that is inexpensive to manufacture.

It is yet a further object of the present invention to provide a product dispenser package for personal use that may include measuring markings for readily identifying the quantity of liquid or viscous product contained therein.

These and other objects and advantages of the present invention are readily apparent with reference to the detailed description and accompanying drawings.

SUMMARY OF THE INVENTION

The present invention is directed to a product dispenser package for personal use that is configured and sized for dispensing a liquid or viscous product. Each product dispenser package for personal use is formed of polypropylene, a well known packaging material. In a preferred embodiment, an elongated stem on one end of the dispenser package is provided, having an aperture adaptable for dispensing a variety of products, ranging from liquid to considerably viscous products. To prevent inadvertent emission of the product, and in order to keep the aperture of the dispenser package closed and sanitary prior to use, a portion of the applicable end of the dispenser package is folded over on itself and sealed with a food grade adhesive. The food grade adhesive seal may be easily broken by the user for dispensing the liquid or viscous product. In an alternative embodiment, a band is used to prevent the folded segments from inadvertently unfolding, wherein the folded segment portion of the dispenser package engages the band and is held in together by the band prior to the band being removed for use of the product. Other alternative embodiments of the product dispenser package include a removable cap for sealing the aperture prior to use of the product and does not require that a portion of the product dispenser be folded over itself. In some embodiments of the product dispenser package including a removable cap, the product dispenser package may include an amount of liquid or viscous product suitable for multiple uses, wherein the removable cap is reusable. The product dispenser packages are tube-shaped to allow for easy squeezing and emission of the product via the aperture.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
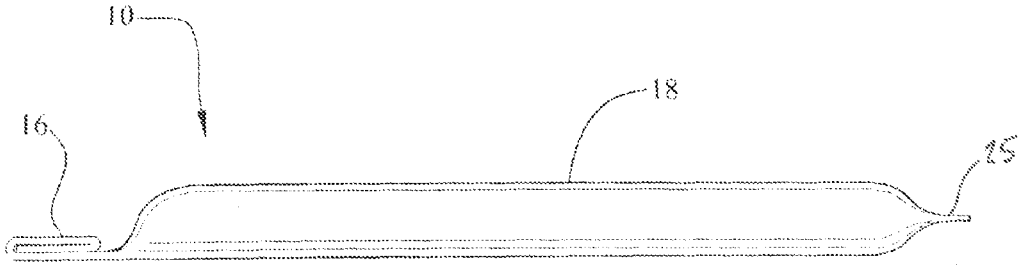
FIG. 1 is a side elevational view of the product dispenser package of the present invention according to one embodiment thereof.

Referring to the several views of the drawings, and initially FIGS. 1-3B, the product dispenser package for storing and dispensing liquid and viscous products for personal use is shown and is generally indicated as 10.

A product dispenser package for personal use 10 is formed of polypropylene in a tube-shaped form, as seen in FIGS. 1-3B. In a preferred embodiment, the product dispenser package 10 is sized and configured for containing a measured quantity amounting to a single serving of a liquid or viscous product 12 that may be emitted via an aperture 14 located on an elongated stem 16 in communication with the top end of the container 18 of the dispenser package 10. The liquid or viscous product 12 is stored in an interior chamber 19 within the container 18 and may be emitted therefrom by squeezing the end of the container 18 opposite of the aperture 14 using one's fingers and subsequently directing one's squeezed fingers along the length of the container 18 towards the aperture 14, thereby forcing the product 12 stored within the interior chamber 19 into the interior channel 21 of the elongated stem 16 extending between the interior chamber 19 and the aperture 14. The aperture 14 preferably extends nearly the entire width of the elongated stem 16 for easy and sanitary emission of the product 12. The bottom end 25 of the container 18 is crimped or pinched and heat sealed to prevent leakage and exit of the product 12 from the bottom end 25 of the container 18.

Figure 3A:
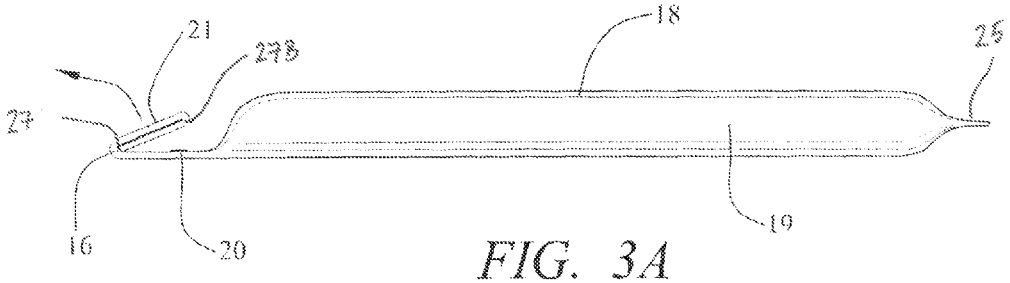
FIGS. 3A and 3B show a side elevation view of the product dispenser package of the present invention according to one embodiment, illustrating the process for opening a product dispenser package for personal use.
Figure 3B:
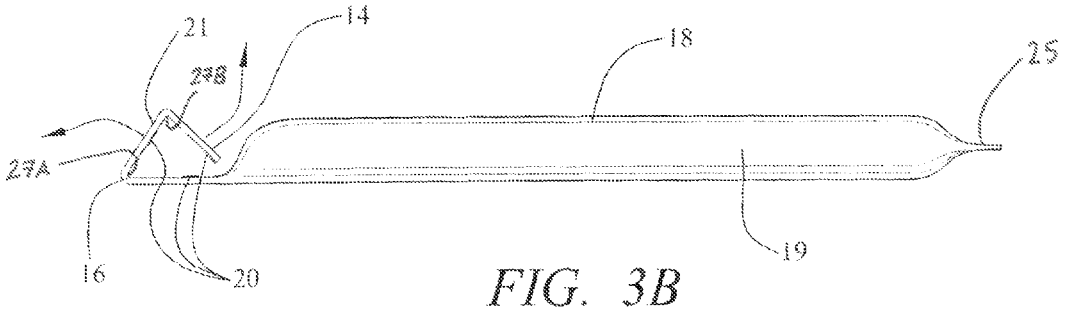

In a preferred embodiment, the elongated stem 16 of the dispenser package 10 is folded over on itself, preferably multiple times as illustrated in FIG. 3, thereby pinching closed the interior channel 21 and preventing the liquid or viscous product 12 from being inadvertently emitted through the aperture 14. The multiple fold and crease points 27A and 27B each define an area of closure. Accordingly, the multiple areas of closure provide a reinforced, redundant closure system to seal the dispenser package 10 closed and significantly increase the integrity of the closure to prevent leakage of the liquid or viscous product 12. A food grade adhesive 20 is applied to portions of the elongated stem 16 of the dispenser package 10 to releasably seal together the folded segments of the elongated stem 16, thereby ensuring the elongated stem 16 does not inadvertently unfold prior to its intended use. The seal produced by the food grade adhesive 20 can be broken by the user with the fingers when it is desired to dispense the liquid or viscous product 12.

Figure 2:
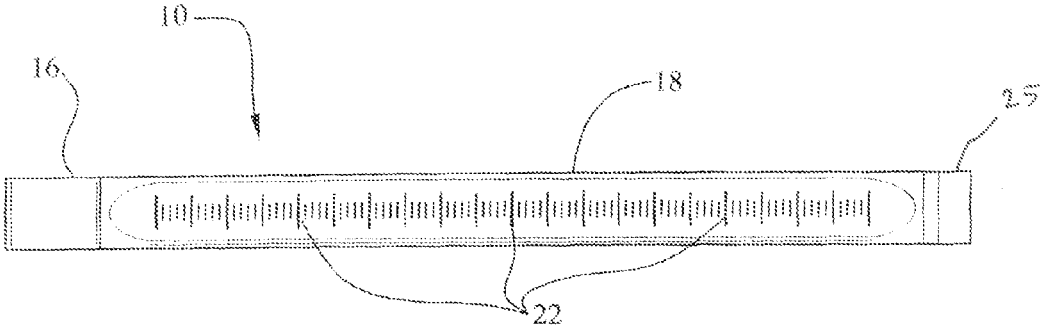
FIG. 2 is a top plan view of the product dispenser package of FIG. 1 showing measurement markings on the dispenser package.

In one embodiment of the dispenser package 10, a measuring marker 22 or a sequence of measuring markings 22 is included on the container 18, wherein the product 12 is visible through the container 18, making the amount of product 12 readily identifiable to a user, as shown in FIG. 2. Such measuring markings 22 would be particularly desirable where the dispenser package 10 contains an amount of liquid or viscous medicine.

Figure 4:
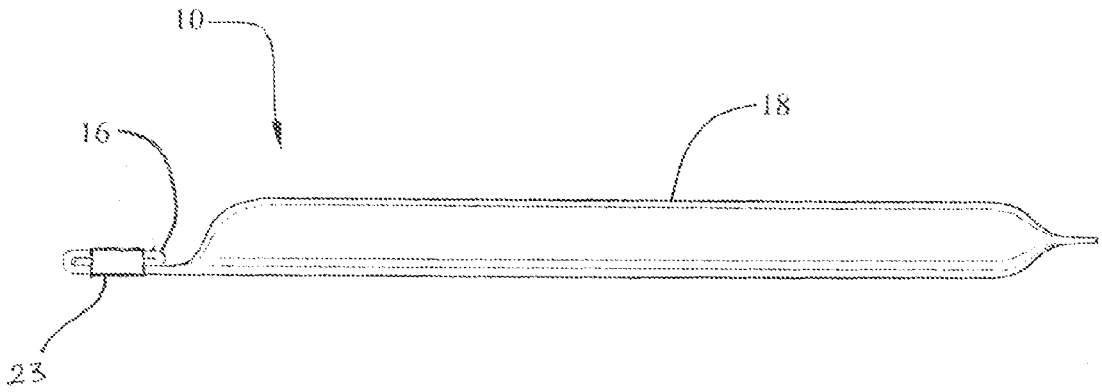
FIG. 4 is a side elevational view of an alternative embodiment of the product dispenser package of the present invention.
Figure 4A:
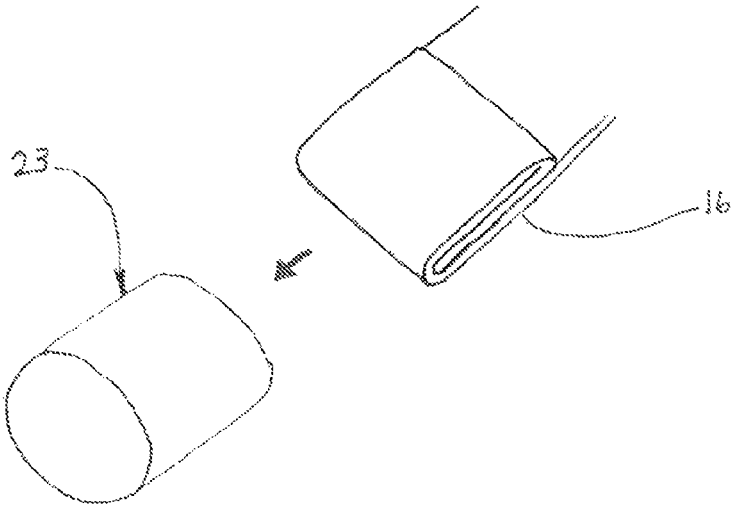
FIG. 4A is an isolated perspective view illustrating removal of a closure band from the elongated stem of the dispenser package of FIG. 4.

Referring to FIGS. 4 and 4A, an another embodiment of the product dispenser package for personal use 10 is shown, which includes a closure band 23 sized and configured for engaged receipt of the folded portion of the elongated stem 16. The closure band 23 prevents the elongated stem 16 from inadvertently unfolding and releasing the liquid or viscous product 12. This alternative embodiment of the product dispenser package 10 does not require the use of a food grade adhesive 20 to hold the elongated stem 16 in the folded and sealed position prior to use.

Figure 5:
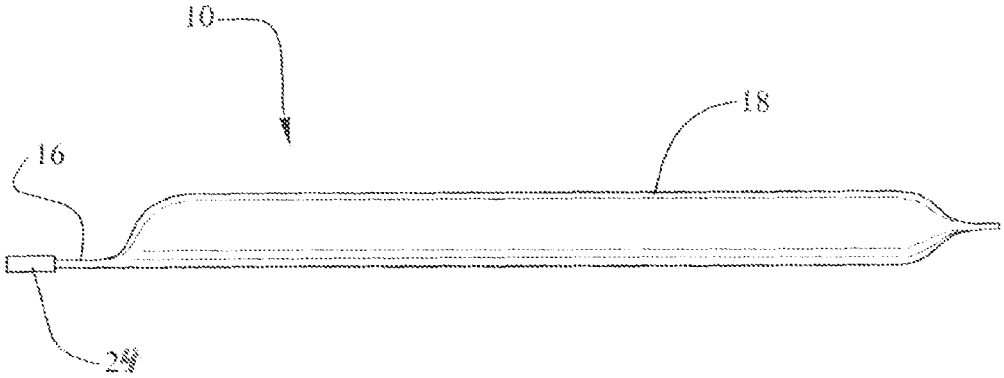
FIG. 5 is a side elevational view of an alternative embodiment of the product dispenser package for personal use of the present invention.

Referring to FIG. 5, a further embodiment of the product dispenser package for personal use 10 is shown, wherein the elongated stem 16 is not foldable and includes a breakaway cap 24 adjacent to aperture 14, for preventing inadvertent emission of the product 12. The breakaway cap 24 is adapted to be removed by the user, with the fingers, to reveal the aperture 14 for dispensing of the product 12.

Figure 6:
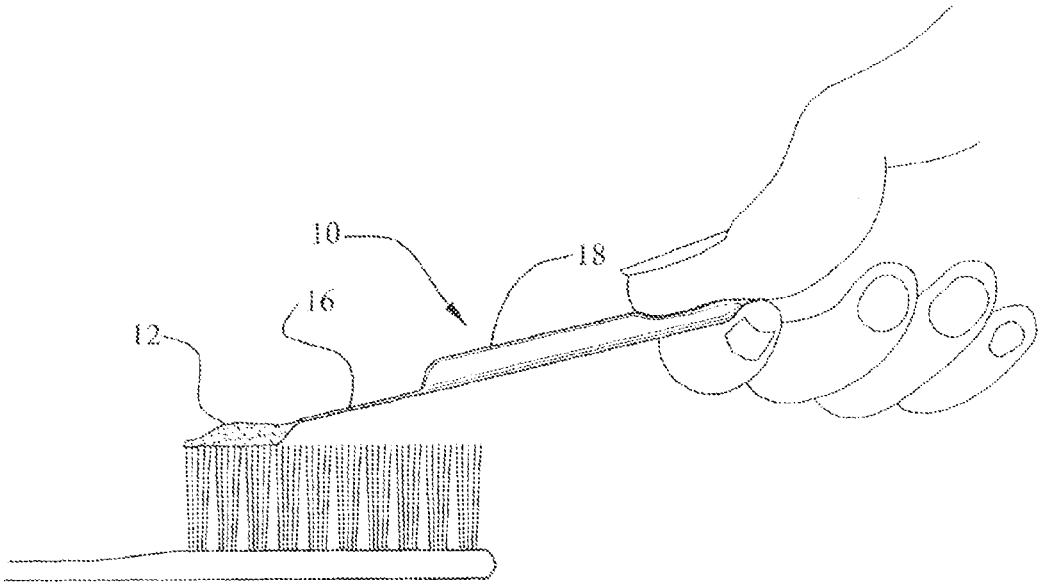
FIG. 6 is a side view of the product dispenser package, shown in accordance with one preferred embodiment, wherein toothpaste is dispensed from the product dispenser package.
Figure 7:
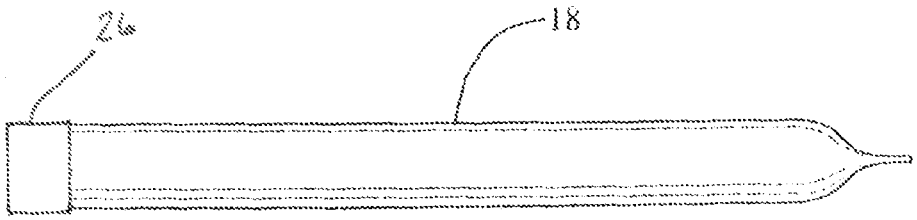
FIG. 7 is a side elevational view of the product dispenser package of the present invention according to yet a further embodiment.

As shown in FIG. 6, the aperture 14 is sized and positioned to allow the product 12 to be emitted from the product dispenser package 10 without requiring that the dispenser package 10 come into contact with the object intended to receive the product 12, such as a toothbrush, as illustrated in FIG. 7. The small size of the interior channel 21 and aperture 14 relative to the interior chamber 19 makes squeezing the product 12 out of the aperture 14 easy and does not require that the user's fingers get close to the product 12 or aperture 14. The small size of the interior channel 21 and aperture 14 relative to the interior chamber 19 further makes the dispenser package 10 useful for containing a range of products, such as toothpaste, mouthwash, shampoo, medicinal liquids and creams, and food items.

Figure 7A:
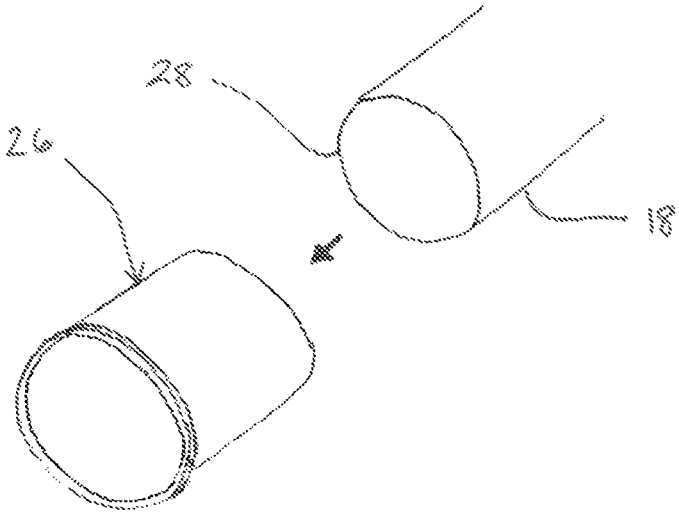
FIG. 7A is an isolated perspective view, illustrating removal of a cap from the dispenser package of FIG. 7.

Referring to FIGS. 7 and 7A, yet a further embodiment of the product dispenser package for personal use 10 is shown, which includes a removable cap 26 that seals an opening 28 on container 18 that is in communication with interior chamber 19. The removable cap 26 is reusable and, accordingly, this particular embodiment of the product dispenser package 10 is suitable for containing an amount of product 12 for multiple uses, wherein the removable cap 26 is replaced after each use until the contents are completely emptied from the interior chamber. This multi-use product dispenser package 10 is particularly useful for products such as cosmetics and other creams.

Figure 8:
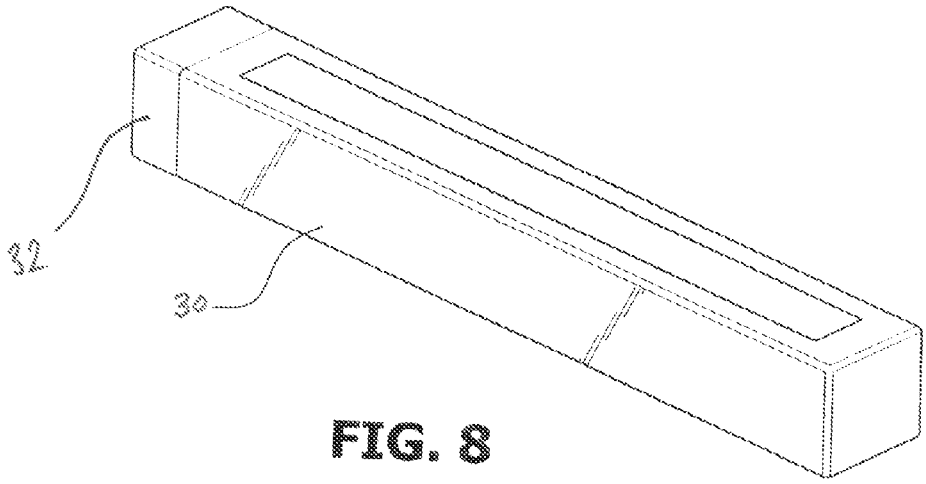
FIG. 8 is a perspective view of a cartridge for storing the product dispenser package of the present invention.
Figure 9:
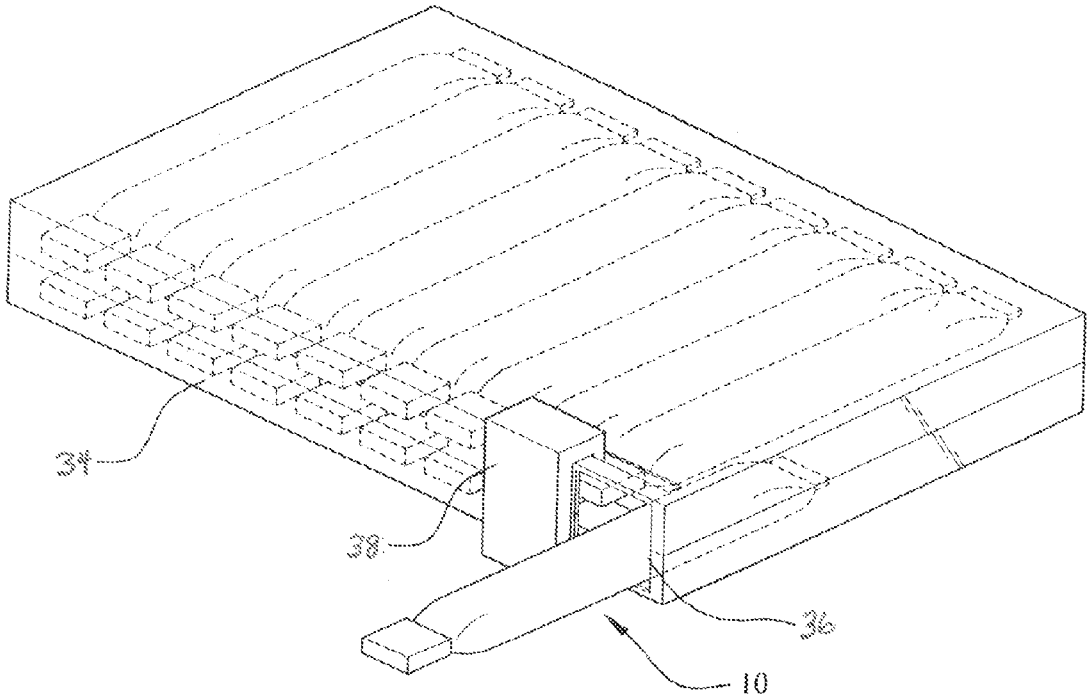
FIG. 9 is a perspective view of a dispenser cartridge for storing multiple product dispenser packages.
Figure 10:
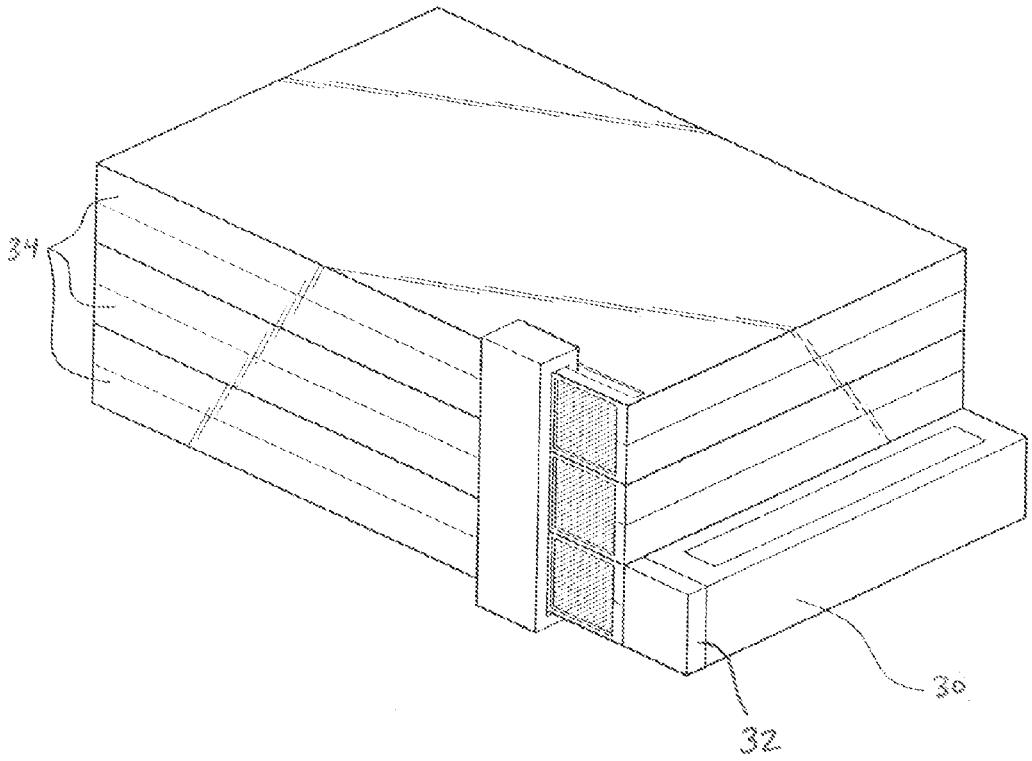
FIG. 10 is a perspective view of multiple dispenser cartridges, each for storing multiple individual product dispenser packages, and wherein the dispenser cartridges are shown in connection with each other.

Referring to FIGS. 8-10, a cartridge 30 having a removable top 32 is provided for storing a product dispenser package 10. A dispenser cartridge 34 may also be provided for storing multiple dispenser packages 10, as shown in FIG. 9, wherein the dispenser packages 10 are accessible via an opening 36 on the dispenser cartridge 34. A sliding door 38 is structured to be opened and closed for providing and restricting access to the opening 36, respectively. Referring specifically to FIG. 10, a preferred method of packaging the product dispenser package 10 is shown, wherein multiple cartridges 30 may be packaged alongside dispenser cartridges 34 for convenient accessibility.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A product dispenser package for storing a viscous product for personal use, said product dispenser package comprising:

a container formed from a single unitary wall structure extending from a first end to an opposite second end, and said first end being closed and said opposite second end including an aperture defining a dispensing outlet, and said unitary wall structure including a first portion surrounding an interior chamber and a second portion defining an elongate stem surrounding an interior channel extending in fluid flow communication between said interior chamber and said aperture at said opposite second end;

said interior chamber extending from said first end of said container and towards said opposite second end and terminating prior to said second end of said container;

said interior channel extending between said interior chamber and said aperture at said second end of said container;

said elongate stem being foldable, wherein at least one segment of said elongate stem is foldable onto another segment of said elongate stem, thereby pinching closed the interior channel and preventing passage of the viscous product;

a removable band sized and configured for engaged, fitted receipt over the folded segments of said elongate stem, said removable band being structured and disposed for holding the segments in the folded position for preventing release of the viscous product stored in the unitary wall structure prior to use of said product dispenser package; and wherein squeezing one's fingers against said first portion of said unitary wall structure of said container and directing one's fingers along the length of said container from the bottom end of said container towards the top end of said container forces the viscous product stored in the interior chamber through the interior channel and out of the aperture.

2. A product dispenser package for storing a viscous product for personal use, said product dispenser package comprising:

a container formed from a single unitary wall structure extending from a first end to an opposite second end, and said first end being closed and said opposite second end including an aperture defining a dispensing outlet, and said unitary wall structure including a first portion surrounding an interior chamber and a second portion defining an elongate stem surrounding an interior channel extending in fluid flow communication between said interior chamber and said aperture at said opposite second end;

said interior chamber extending from said first end of said container and towards said opposite second end and terminating prior to said second end of said container;

said interior channel extending between said interior chamber and said aperture at said second end of said container;

a removable closure mechanism sized and configured for engaged, fitted attachment to the second end of the unitary wall structure to maintain the aperture of said container closed when in the engaged position for preventing release of the viscous product stored in the unitary wall structure prior to use of said product dispenser package; and wherein squeezing one's fingers against said first portion of said unitary wall structure of said container and directing one's fingers along the length of said container from the bottom end of said container towards the top end of said container forces the viscous product stored in the interior chamber through the interior channel and out of the aperture.

3. The product dispenser package as recited in claim 2 wherein said viscous product is toothpaste.

4. The product dispenser package as recited in claim 2 wherein said viscous product is mouthwash.

5. The product dispenser package as recited in claim 2 wherein said viscous product is shampoo.

6. The product dispenser package as recited in claim 2 wherein said viscous product is medicine.

7. The product dispenser package as recited in claim 2 wherein said viscous product is a food product.

8. The product dispenser package as recited in claim 2 wherein said container and said elongate stem are made of polypropylene.

* * * * *